US010688334B2

(12) United States Patent
Huang

(10) Patent No.: US 10,688,334 B2
(45) Date of Patent: Jun. 23, 2020

(54) STRETCH EXERCISE SYSTEM

(71) Applicant: Yu-Fen Huang, Cupertino, CA (US)

(72) Inventor: Yu-Fen Huang, Cupertino, CA (US)

( * ) Notice: Subject to any disclaimer, the term of this patent is extended or adjusted under 35 U.S.C. 154(b) by 90 days.

(21) Appl. No.: 15/950,570

(22) Filed: Apr. 11, 2018

(65) Prior Publication Data

US 2018/0290010 A1 Oct. 11, 2018

(30) Foreign Application Priority Data

Apr. 11, 2017 (TW) ..... 106204956 A

(51) Int. Cl.
*A63B 21/00* (2006.01)
*A63B 21/04* (2006.01)
(Continued)

(52) U.S. Cl.
CPC ..... *A63B 21/4025* (2015.10); *A61H 1/0266* (2013.01); *A61H 1/0292* (2013.01);
(Continued)

(58) Field of Classification Search
CPC ..... A63B 21/0004; A63B 21/00043; A63B 21/00058; A63B 21/00061; A63B 21/00065; A63B 21/00069; A63B 21/00072; A63B 21/00076; A63B 21/00178; A63B 21/00181; A63B 21/00185; A63B 21/002; A63B 21/0023; A63B 21/02; A63B 21/04; A63B 21/0407; A63B 21/0414; A63B 21/0421; A63B 21/0428; A63B 21/0435; A63B 21/0442; A63B 21/045; A63B 21/0455; A63B 21/055; A63B 21/0552; A63B 21/0555; A63B 21/0557; A63B 21/065; A63B 21/068; A63B 21/15; A63B 21/151; A63B 21/152; A63B 21/159; A63B 21/16; A63B 21/4001; A63B 21/4003; A63B 21/4005; A63B 21/4007; A63B 21/4009; A63B 21/4011; A63B 21/4013; A63B 21/4015; A63B 21/4017; A63B 21/4019; A63B 21/4021; A63B 21/4023; A63B 21/4025;
(Continued)

(56) References Cited

U.S. PATENT DOCUMENTS 3,411,500 A * 11/1968 Gatts ..... A63B 21/4007 600/20
4,986,261 A * 1/1991 Iams ..... A61H 1/0218 482/51
(Continued)

*Primary Examiner* — Gary D Urbiel Goldner
(74) *Attorney, Agent, or Firm* — K&L Gates LLP

(57) ABSTRACT

A stretch exercise system includes a waist harness, an upper limb extension unit having a right and a left upper limb elastic straps which are set symmetrically on the waist harness, a wrist loop, a lower limb extension unit having a right and a left lower limb elastic strap units which are set symmetrically on the waist harness, two Achilles tendon retro-stretch angle units connecting with the right and the left lower limb elastic strap units respectively, and two sole fastening units set thereon respectively to hold feet of a user. When the system is operated, a static balance is reached with a force applied on the upper limb extension unit and a force applied on the Achilles tendon retro-stretch angle units by the user.

13 Claims, 12 Drawing Sheets

(51) Int. Cl.

| | |
|---|---|
| ***A63B 21/055*** | (2006.01) |
| ***A63B 23/03*** | (2006.01) |
| ***A63B 23/035*** | (2006.01) |
| ***A61H 1/02*** | (2006.01) |
| ***A63B 23/00*** | (2006.01) |

(52) U.S. Cl.
CPC .... *A63B 21/00185* (2013.01); *A63B 21/0442* (2013.01); *A63B 21/0552* (2013.01); *A63B 21/4009* (2015.10); *A63B 21/4034* (2015.10); *A63B 21/4035* (2015.10); *A63B 23/03* (2013.01); *A63B 23/03525* (2013.01); *A63B 23/03541* (2013.01); *A63B 23/03575* (2013.01); *A61H 2201/0157* (2013.01); *A61H 2201/1261* (2013.01); *A61H 2201/163* (2013.01); *A61H 2201/165* (2013.01); *A61H 2201/1611* (2013.01); *A61H 2201/1642* (2013.01); *A63B 2023/006* (2013.01)

(58) Field of Classification Search
CPC ..... A63B 21/4027; A63B 21/4033; A63B 21/4034; A63B 21/4035; A63B 21/4039; A63B 21/4041; A63B 21/4043; A63B 21/4045; A63B 2023/003; A63B 2023/006; A63B 23/02; A63B 23/0205; A63B 23/0211; A63B 23/0216; A63B 23/0222; A63B 23/0227; A63B 23/0233; A63B 23/0238; A63B 23/025; A63B 23/03; A63B 23/035; A63B 23/03516; A63B 23/03525; A63B 23/03533; A63B 23/03541; A63B 23/0355; A63B 23/03575; A63B 23/04; A63B 23/12; A63B 26/00; A63B 26/003; A63B 69/0057; A63B 69/0059; A63B 2069/0062; A63B 71/0054; A63B 2071/0063; A63B 2071/0072; A63B 2071/0081; A63B 2208/0242; A63B 2208/0252; A63B 2225/09; A63B 2225/093
USPC ..... 482/907
See application file for complete search history.

(56) References Cited

U.S. PATENT DOCUMENTS

| | | | | | |
|---|---|---|---|---|---|
| 5,688,213 | A * | 11/1997 | Recker | A63B 21/0004 | 482/125 |
| 5,716,307 | A * | 2/1998 | Vadher | A43B 7/20 | 482/124 |
| 5,820,534 | A * | 10/1998 | Vadher | A63B 21/055 | 482/124 |
| 5,993,362 | A * | 11/1999 | Ghobadi | A63B 21/0004 | 482/121 |
| 6,099,446 | A * | 8/2000 | Johnson | A63B 21/0004 | 482/124 |
| 8,915,827 | B2 * | 12/2014 | Cranke | A63B 21/0557 | 36/132 |
| 8,968,166 | B2 * | 3/2015 | Cranke | A63B 21/0442 | 482/121 |
| 9,610,471 | B1 * | 4/2017 | Langlois | A63B 21/0552 | |
| 9,764,180 | B2 * | 9/2017 | Bybee | A63B 21/0442 | |
| 2002/0187885 | A1 * | 12/2002 | Liao | A63B 21/0552 | 482/126 |
| 2007/0135279 | A1 * | 6/2007 | Purdy | A63B 21/0004 | 482/124 |
| 2009/0098945 | A1 * | 4/2009 | George | A63B 21/0552 | 473/213 |
| 2009/0258768 | A1 * | 10/2009 | Clarke | A63B 21/0004 | 482/124 |
| 2010/0041527 | A1 * | 2/2010 | Miller | A63B 21/0552 | 482/124 |
| 2011/0209264 | A1 * | 9/2011 | Williams | A41D 13/0015 | 2/69 |
| 2013/0165302 | A1 * | 6/2013 | Verdi | A63B 71/023 | 482/143 |
| 2013/0190147 | A1 * | 7/2013 | Luo | A63B 21/0552 | 482/122 |
| 2013/0333097 | A1 * | 12/2013 | Cranke | A63B 21/0557 | 2/300 |
| 2016/0101309 | A1 * | 4/2016 | Schreiber | A63B 23/03541 | 482/124 |
| 2016/0256725 | A1 * | 9/2016 | Verdi | A63B 21/4019 | |
| 2017/0028244 | A1 * | 2/2017 | Schreiber | A63B 21/0557 | |
| 2018/0064570 | A1 * | 3/2018 | Kim | A61H 3/008 | |

* cited by examiner

STRETCH EXERCISE SYSTEM

RELATED APPLICATIONS

This application claims the priority of Taiwan Patent Application No. 106204956, filed on Apr. 11, 2017, at the Taiwan Intellectual Property Office, the entire disclosure of which is incorporated herein by reference.

FIELD OF THE INVENTION

The present invention relates to a stretch exercise system, specifically refers to the stretch exercise system which assists the user in implementing the whole body and wide range stretch, and the restoration of user's spinal column.

BACKGROUND OF THE INVENTION

Chronically working with the poor posture without awareness leads to spine displacement, and therefore the spinal cord and the organs in abdominal cavity are vulnerable to compression. As internet getting widespread, computers become the necessary standard equipment to various businesses. However, with the limitation of the arrangement to office furniture and the long-time operation of the keyboard and mouse, office workers suffer from neck and shoulder pain. Additionally, people work in sedentary position at the office desk usually results in rigidity at lower limbs. They slouch all the time while operate computers and handle paperwork.

Even outside of the office, yet as mobile devices prevail over the world, modern people keep themselves in poor postures using mobile devices most of the day. The lack of sport and neglect to exercise, leaves the lower limbs rigid, the shoulders protracted, the upper body in kyphosis and forward head posture. These habits and postures are substantially detrimental to health.

While certain muscle pain occurs, people may do some stretches to sooth and relax the state of tenseness in muscles. However, some pain and discomfort are bounded as the user try to correct unhealthy habitual postures through stretching. When user feels the pain caused by the stretch, the defense mechanism of human instinct drives muscles to resist for protecting the muscles themselves. This mechanism prevents the pain yet antagonizes the stretch. This defense mechanism will dramatically reduce the actual effect of the body stretching movements. Most people stop stretching before actual effectiveness sets in.

Therefore, when exercising body extending movements, also known as stretch, it is more appropriate the exercise proceeds in low intensity and high frequency. It would be ideal if the stretch is exercised with certain auxiliary equipment. Under the assistance of certain auxiliary equipment, discomforts could be eliminated and enjoyment enhanced. The auxiliary equipment could also establish an intended constraint regarding the intensity of the stretch, the user may have more clear awareness about the extent of the stretch.

The ease of use for the auxiliary system has also been considered as one major motivation for users to use it frequently. Being able to apply this auxiliary stretch equipment independently, all by the user himself, is a huge benefit of this current design over other existing rehabilitation equipment. Furthermore, such auxiliary stretch system can be correctly applied without the supervision of professionals.

Nowadays, the common stretch exercise devices on the market are primarily made up of two loop structures for the user to step upon and accompanied by one long elastic strap to combine the loop structures. The user grabs the middle of the long elastic strap and antagonizes the force from the straightened legs with the force exerted by the arms and the upper body. With the collaborated movements, the effect of stretching is achieved for the muscles and tendons at the thighs and calves such as gastrocnemius, soleus and Achilles tendon.

However, the force exerted by the thigh and calf is surprisingly powerful. For example, Achilles tendon bears four times the weight of the body during walking. While running, the workload of Achilles tendon is even seven times more than the body weight. The griping strength of a normal person is inadequate to hold the middle of the long elastic strap of the above mentioned device to stably straightened legs so as to accomplish the stretch.

Moreover, the lower limbs are obviously much stronger than the upper limbs. It is difficult to antagonize the strength of the straightened lower limbs with the muscles of the forearms and the arms of the upper limbs. Therefore, the user often needs to exert additional force to recovering his/her own body from prior forward flexion position to be straight. The above mentioned movement is driven by the muscles on the back during the state of forward flexion. To exert forces at the above mentioned state leaves the user vulnerable to sports injuries and the upper body of the user more flexed, and thus it is obviously contrary to the purpose of relaxing the muscles over the whole body. It is not wise to harm the upper body just for stretching the lower limbs.

The hospital with rehabilitation departments or the fitness center may provide various types of equipments for users to stretch. However, these types of equipments usually are generally bulky, hard to store and impossible to be carried. It is inconvenient for users as most of these equipments require professional supervision and assistance. The users risk themselves for potential injuries if they try to operate these equipments on their own.

SUMMARY OF THE INVENTION

Overall, the shortcomings of the prior art can be classified as follows: (1) they are bulky and hard to store; (2) the assistance of professional supervision is necessary; (3) they are easy to be operated in incorrect posture to cause injuries at other portions of the user and they are unable to provide the extension in whole body; (4) it is difficult to be aware if the extent of stretch is proper, and thus it is difficult to estimate that the stretch should be strengthened or stopped. By present invention, these shortcomings can be overcome.

The present invention provides a stretch exercise system. The stretch exercise system includes a waist harness having a ventral portion and a dorsal portion; an upper limb extension unit having a right upper limb elastic strap and a left upper limb elastic strap symmetrically configured at the dorsal portion, wherein each of the upper limb elastic straps has a wrist loop; a lower limb extension unit having a right lower limb elastic strap unit and configured at the ventral portion, and having a left lower limb elastic strap unit and configured at the ventral portion; two Achilles tendon retro-stretch angle units each having at least a bottom surface and a sole contact surface, wherein the bottom surface and the sole contact surface are not parallel to each other to form a diverging end and a converging end. The right lower limb elastic strap unit connects with the diverging end of one of the two Achilles tendon retro-stretch angle units, and the left lower limb elastic strap unit connects with the diverging end of the other of the two Achilles tendon retro-stretch angle units; and two sole fastening units respectively configured on the Achilles tendon retro-stretch angle units to hold feet of a user on the sole contact surfaces and align toes of the feet of the user with the diverging ends respectively, whereby a static balance is reached by the user with an upper push force applied on the upper limb extension unit and a lower push force applied on the Achilles tendon retro-stretch angle units.

Preferably, the stretch exercise system further comprises an ankle fastening unit configured for securing one of the feet of the user on one of the sole contact surfaces and aligning a tip of a toe of one of the feet of the user with one of the diverging ends.

Preferably, the stretch exercise system further comprises a connect unit for connecting the right upper limb elastic strap and the left upper limb elastic strap, wherein the connect unit is capable of sliding along the right upper limb elastic strap and the left upper limb elastic strap.

Preferably, the stretch exercise system further comprises a mandible harness unit configured for pulling a head of the user and aligning a neck spine of the user, wherein the mandible harness unit connects the right upper limb elastic strap and the left upper limb elastic strap.

Preferably, the stretch exercise system further comprises a support unit configured on each Achilles tendon retro-stretch angle unit for upholding the respective bottom surface to maintain a constant angle relative to a floor.

Preferably, the stretch exercise system further comprises a wedge part having at least a contact surface and a non-contact surface, wherein the contact surface and the non-contact surface are not parallel to each other to form a wedge diverging end and a wedge converging end, and the wedge part is capable of being attached to the sole contact surface with the contact surface in a direction such that the wedge diverging end is aligned with the diverging end and the wedge converging end is aligned with the converging end.

Preferably, the stretch exercise system further comprises a threaded rod engaging through the bottom surface and supported by the sole contact surface, whereby an angle between the bottom surface and the sole contact surface is capable of being adjusted by screwing the threaded rod in and out of the bottom surface.

Preferably, the stretch exercise system wherein the Achilles tendon retro-stretch angle units are bonded in parallel to make each of the bottom surfaces of the Achilles tendon retro-stretch angle units parallel in a same direction.

Preferably, the stretch exercise system further comprises a movable anchoring unit configured for holding a wrist of the user, whereby the movable anchoring unit is capable of being tied with a fixture and configured to counter a contraction resulting from the upper limb extension unit.

Preferably, the stretch exercise system further comprises a movable anchoring unit configured for holding a wrist of the user and connecting the respective Achilles tendon retro-stretch angle unit, whereby the movable anchoring unit spans around a fixture and is configured to counter contractions resulting from the upper limb extension unit, the lower limb extension unit and the movable anchoring unit.

Preferably, the stretch exercise system wherein the right lower limb elastic strap unit at least includes a first right extension unit connecting with the diverging end and a second right extension unit connecting with the respective Achilles tendon retro-stretch angle unit, whereby a pushing force is capable of being absorbed and balanced by the first right extension unit and the second right extension unit to prevent the respective Achilles tendon retro-stretch angle unit from flipping.

According to another aspect of the present invention, the stretch exercise system includes a waist harness having a ventral portion and a dorsal portion; an upper limb extension unit having at least one upper limb elastic strap connecting a wrist loop and the dorsal portion; a lower limb extension unit having at least one lower limb elastic strap unit configured at the ventral portion and corresponding to the at least one upper limb elastic strap; an Achilles tendon retro-stretch angle unit having at least a bottom surface and a sole contact surface, wherein the bottom surface and the sole contact surface are not parallel to each other to form a diverging end and a converging end, and the at least one lower limb elastic strap unit at least connects the diverging end; and a sole fastening unit configured on the Achilles tendon retro-stretch angle unit for holding one foot of a user.

According to another aspect of the present invention, the stretch exercise system includes a waist harness having a ventral portion and a dorsal portion; an upper limb extension unit having at least one upper limb elastic strap connecting a wrist loop and the dorsal portion; a lower limb extension unit having at least one lower limb elastic strap unit configured at the ventral portion and corresponding to the upper limb elastic strap; an Achilles tendon retro-stretch angle unit connecting with the lower limb extension unit and having at least a base plate, a sole contact plate pivoting upon the base plate and a support pole pivoting upon the sole contact plate; and a sole fastening unit configured on the Achilles tendon retro-stretch angle unit to hold one foot of a user, wherein the base plate includes a plurality of accommodating holes to hold the support rod, whereby an angle between the base plate and the sole contact plate is capable of being adjusted when different accommodating holes are occupied with the support rod.

BRIEF DESCRIPTION OF THE DRAWINGS

The present invention will be more clearly understood through the following descriptions with reference to the drawings.

DETAILED DESCRIPTION OF THE PREFERRED EMBODIMENTS

Figure 1:
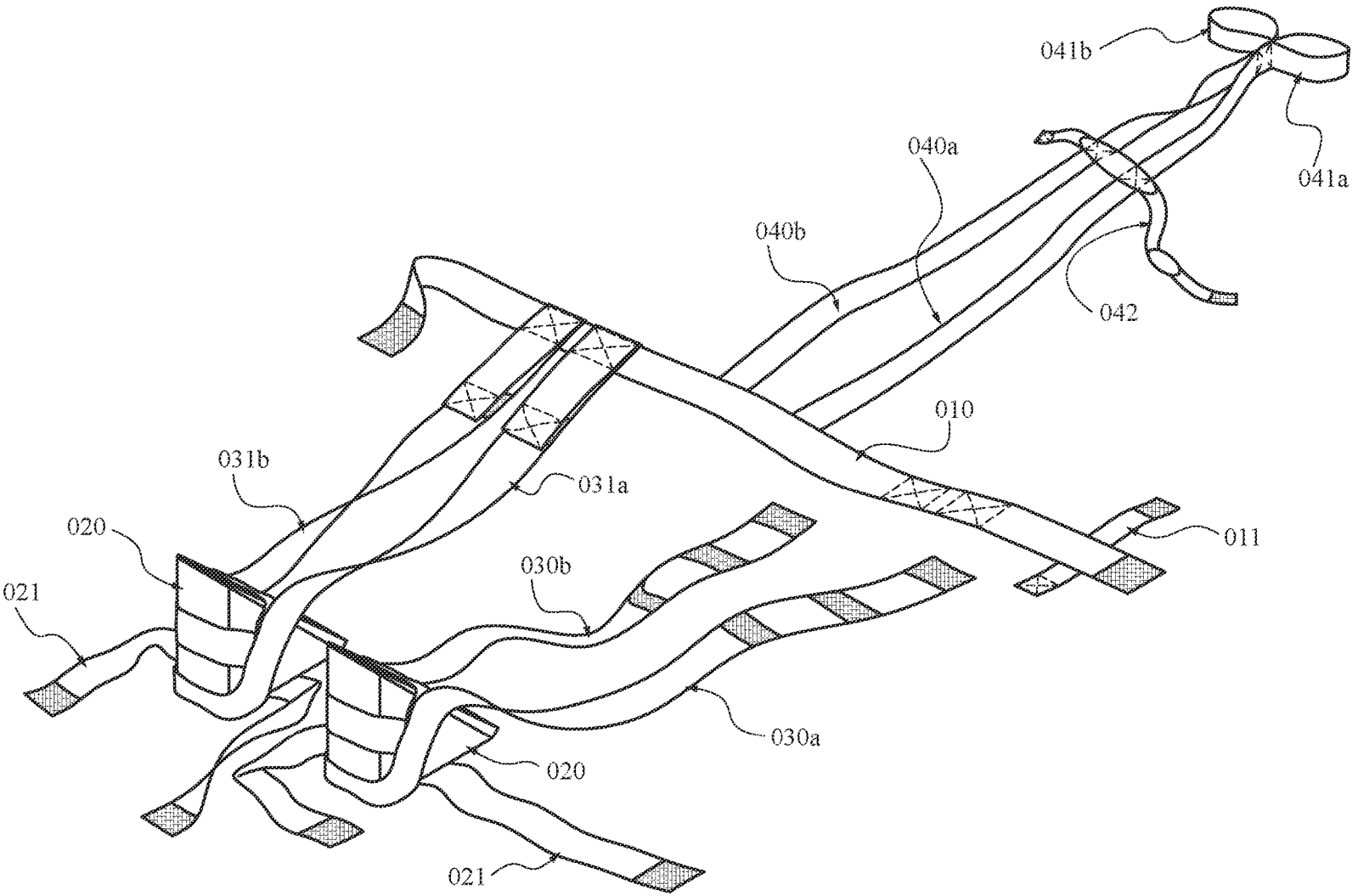
FIG. 1 is the perspective view of the first embodiment of the present invention.
Figure 2:
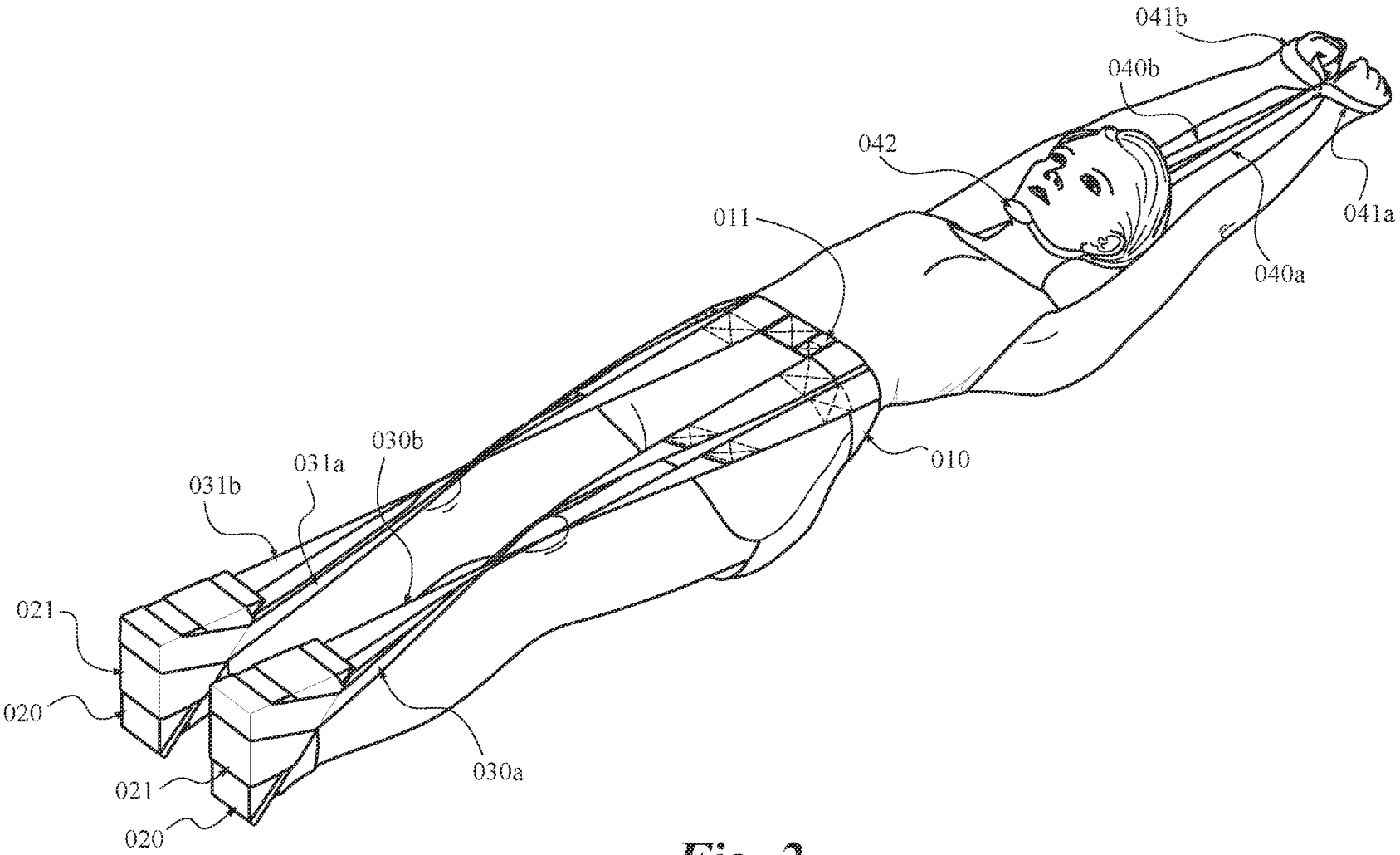
FIG. 2 shows the state in operation of the first embodiment of the present invention.

Please refer to FIGS. 1 and 2, which show a stretch exercise system disclosed by the present invention. The connections and functions of the major elements are described as follows. A waist harness 010 is able to enclose the waist of a user. In the first embodiment, the perimeter of the waist harness 010 can be adjusted by applying the VELCRO so as to accommodate the user size variation for enclosure of the waist of the user. However, it is not limited to the VELCRO to implement the present invention. The means or mechanisms that fasten two straps in parallel or overlap can be used for the waist harness 010, such as the belt structure, buckle structure and button structure.

When the VELCRO or button structure are adopted, a safety fastener strap 011 is set additionally to prevent the VELCRO or button structure from abrupt snap due to the load of the VELCRO or button structure. The safety fastener strap 011 is configured onto the waist harness 010 in perpendicular direction and the fastener strap 011 is pressed upon the VELCRO or button structure in the same direction.

After the waist harness 010 encloses around the waist of the user, the appearance of the waist harness 010 can be divided into a ventral portion and a dorsal portion. The upper limb extension unit 040*a* (and 040*b*) of the major elements is configured at the dorsal portion and the lower limb extension unit 030*a* (and 030*b*, 031*a*, 031*b*) is configured at the ventral portion. In the aspect of static balance, the configuration has the advantage. Because the upper limb extension unit 040*a* (and 040*b*) and the lower limb extension unit 030*a* (and 030*b*, 031*a*, 031*b*) are attached to the waist harness 010, the contractions coming from the upper limb extension unit 040*a* (and 040*b*) and the lower limb extension unit 030*a* (and 030*b*, 031*a*, 031*b*) can reconcile each other. Therefore, the load upon the waist harness 010 is minimized when waist harness 010 is fastened around the waist of the user.

On the other hand, structurally, the lower limb extension unit 030*a* (and 030*b*' 031*a*' 031*b*) would be located at the ventral side (ie. the front) of the user to get the effect of stretching the Achille tendons and the muscles at the rear of the legs. If the upper limb extension unit 040*a* (and 040*b*) was also located at the ventral side of the user, it would make user's spinal column bend forward. Such design would not only lift the risk of sports injuries and increase the workload upon the back muscles of the user, but also result in the organs in the abdominal cavity compressed and the shoulders protracted. For these reasons, the upper limb extension unit 040*a* (and 040*b*) is configured at the ventral side of the user.

Furthermore, the above mentioned configuration also have the benefit of stretching the spinal cord and restoring the spinal column. In the life style of modern society, the thoracic and lumbar of most people are kept in the state of long term flexion, but the cervical vertebrae are kept in the state of looking up or pitching up (ie. forward head posture). These postures make spinal column forced improperly over a long period of time. This results in gradual dislocation of each vertebra, and finally the nerves branch out from the spinal cord as the vertebrae crush. The above mentioned configuration promotes the user to stand up straight and stretch in a way reverse from the habitual incorrect posture. As a benefit, the above mentioned configuration realigns the neck, thoracic, lumbar and cervical vertebrae to the correct relative position to restore the spinal column.

The upper limb extension unit can be divided into a left upper limb elastic strap 040*a* and a wrist loop 041*a*, which are corresponding to the left hand of the user, and a right upper limb elastic strap 040*b* and a wrist loop 041*b*, which are corresponding to the right hand of the user. To increase the stability when the user operates the present invention, a connection can be set between the wrist loop 041*a* and the wrist loop 041*b*. The implementation of the connection can be as shown FIG. 1. For example, the connection can be implemented by sewing up or a buckle. Under this arrangement to implement, after wearing the waist harness 010, the user can hold the wrist loop 041*a* with left hand, place it right above head to help right hand to hold the wrist loop 041*b*, and then the user is allowed to exert the force upward to against the left upper limb elastic strap 040*a* and the right upper limb elastic strap 040*b*. This movement enables the stretches for pectoralis major, rectus abdominis and latissimus dorsi, and it also relaxes the discomfort at shoulders caused by being sedentary.

In the above mentioned embodiment, a mandible harness unit 042 can be applied to the present invention additionally. The mandible harness unit 042 is connected with the left upper limb elastic strap 040*a* and the right upper limb elastic strap 040*b*, and encloses a circle around mandible and occipital bone of the user. When the user exerts his/her hands upward against the left upper limb elastic strap 040*a* and the right upper limb elastic strap 040*b*, the mandible harness unit 042 is driven to move upward so as to stretch the sternocleidomastoid and upper trapezius around the user's neck and reset the displacement of the cervical vertebrae.

The size variation of the harness unit 042 for different users is considered and accommodated accordingly. The connection among the mandible harness unit 042, the left upper limb elastic strap 040*a* and the right upper limb elastic strap 040*b* has to be implemented adjustably. For example, it can be performed by VELCRO, automatic belt buckle structure, toothed clip buckle structure and so on. In conclusion, the mandible harness unit is located right under the jaw bone, and is applied to align the neck spine of the user's with the up-pulling force created jointly by the right upper limb elastic strap and the left upper limb elastic strap.

After wearing the waist harness 010, the user raises both of his hands until the arms are fully straightened and the upper arms are placed right next the ears. Then the user puts his hands through the wrist loop 041*a* and the wrist loop 041*b*, and moves his hands above the head. At this point, the user may start to breathe freely and enjoy effortless relaxation. The way to exert forces focuses on the stretch of the latissimus dorsi of the user.

The end posture of any stretch or relax movements has to be kept for a while to be optimized. Considering that the user's muscle strength might not be adequate to sustain the end posture for a long time, and the defense mechanism of human instinct due to the user's habitual poor posture, the stretch exercise may be facilitated by a device which would migrate all the efforts that the user has to exert toward an anchor fixed at the opposite direction. Therefore, the present invention additionally provides a movable anchoring unit to hold the user's hands, after the user lay his wrists upon the wrist loops, to assist the user staying in the end posture effortlessly. The movable anchoring unit transforms this whole body stretch to be an automatic, effortless exercise.

One of the embodiments for the movable anchoring unit is a strap and a fastening structure attached at the middle of the strap, such as a loop or a clasp. The strap can be tied up to a fixed construction or object. When the strap is tied, let the loop or the clasp be set at the location where the user can reach under the end posture. When the stretch goes to the end posture, the user can rest his hands on the loop or the clasp. Therefore, the end posture of the stretch can be supported by the loop or the clasp, and a state of automatic stretch can be realized.

Most voluntary muscles of the human body are paired and antagonistic to each other, and therefore when certain muscle is stretching, there must be one corresponding muscle which is contracting and in the exerting state. The traction provided by the movable anchoring unit can substitute the corresponding muscle, and therefore the user is allowed to have a complete relaxing experience.

The fastening structure of the movable anchoring unit also can be implemented with an alternative approach, such as a loop structure. The above mentioned effect also can be achieved by the means that the user holds or puts the wrist into the loop structure, which is secured at the opposite direction, when the stretch goes to the end posture.

In the first embodiment of the present invention, the lower limb extension unit 030*a* (or 030*b*, 031*a*, 031*b*) essentially includes a right lower limb elastic strap unit 031*a* (or 031*b*) and a left lower limb elastic strap unit 030*a* (or 030*b*), and they are connected to the Achilles tendon retro-stretch angle units 020 correspondingly. The optimized configuration of the first embodiment is described in detail as follows. If the tolerance to the balance for the lower limb muscle group, such as all the muscles of the left leg, has to be increased when the user is exerting forces, the left lower limb elastic strap unit 030*a* (or 030*b*) can be implemented with two elastic objects, a first left extension unit 030*a* and a second left extension unit 030*b*. Because they are arranged in parallel or cross to each other, the balance can be achieved. In that way, the foot of the user is prevented from inversion (supination) or eversion (pronation). By the same reason, the right lower limb elastic strap unit 031*a* (or 031*b*) can be implemented with two elastic objects, a first right extension unit 031*a* and a second right extension unit 031*b*. The state of end posture for the first embodiment is shown as FIG. 2.

Figure 3A:
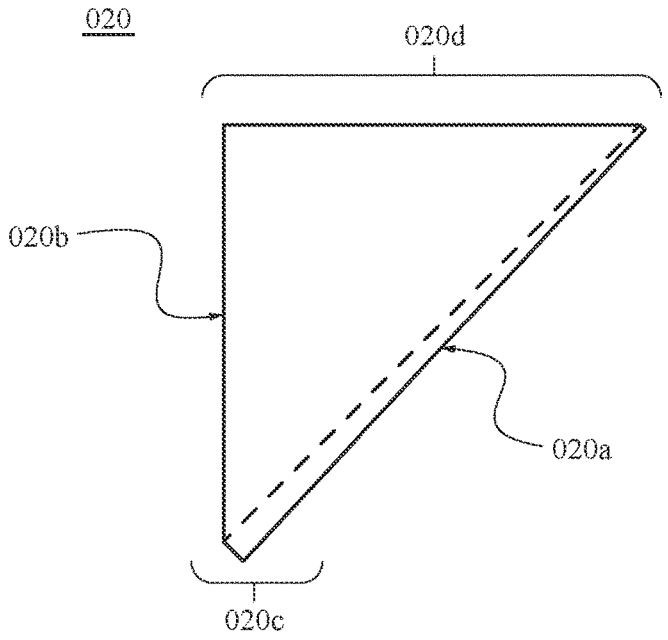
FIG. 3*a* is the side view of the Achilles tendon retro-stretch angle unit of the first embodiment of the present invention.

Referring to FIG. 3*a*, one single Achilles tendon retro-stretch angle unit 020 includes a sole contact surface 020*a* and a bottom surface 020*b*, which are not parallel to each other, and therefore they make a converging end 020*c* and a diverging end 020*d*, wherein the sole contact surface 020*a* is for user to step on. The diverging end 020*d* connects to one lower limb extension unit. For example, in the aspect of right leg, the diverging end 020*d* of the Achilles tendon retro-stretch angle unit 020, which bears the right sole, at least connects to one of the first right extension unit 031*a* and the second right extension unit 031*b*. The other extension unit which does not connect to the diverging end 020*d* can be connected other part of the Achilles tendon retro-stretch angle unit 020 in the way keeping balance when the Achilles tendon retro-stretch angle unit 020 carries the force of stepping on. Thus, under the premise that inversion or eversion are avoided, the purpose for the stretch is accomplished.

Figure 3B:
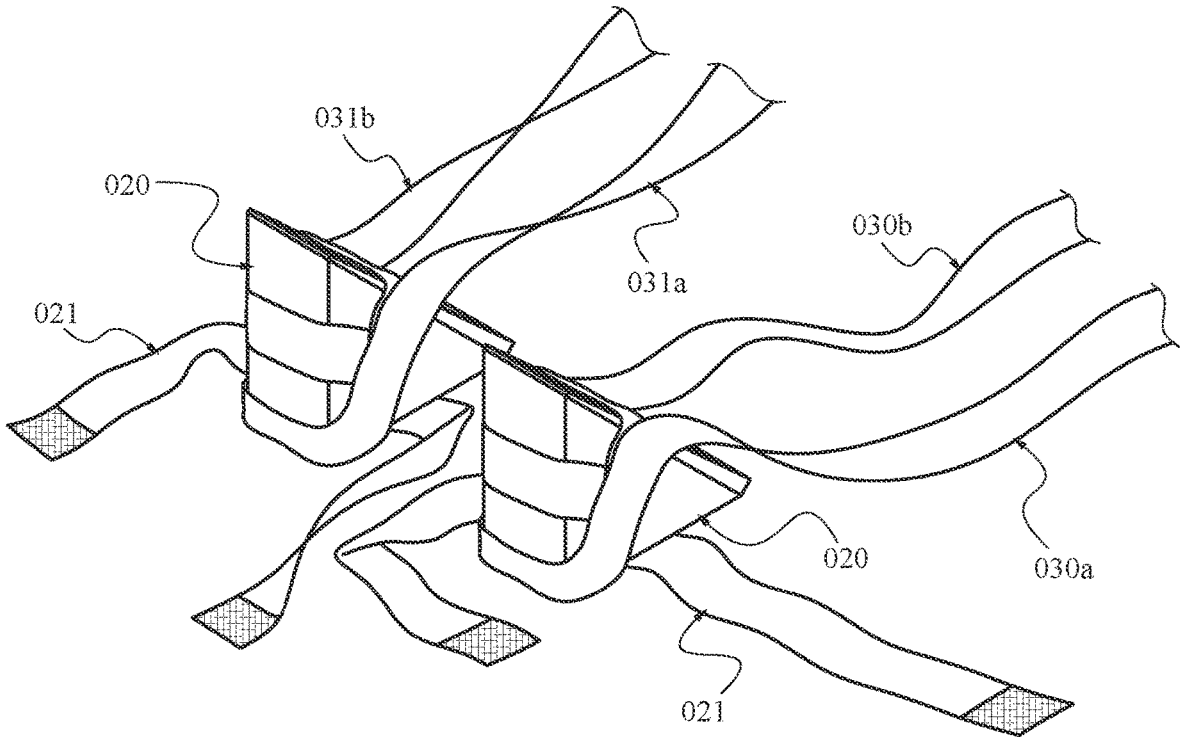
FIG. 3*b* is the partial perspective view of the Achilles tendon retro-stretch angle unit of the first embodiment of the present invention.
Figure 4:
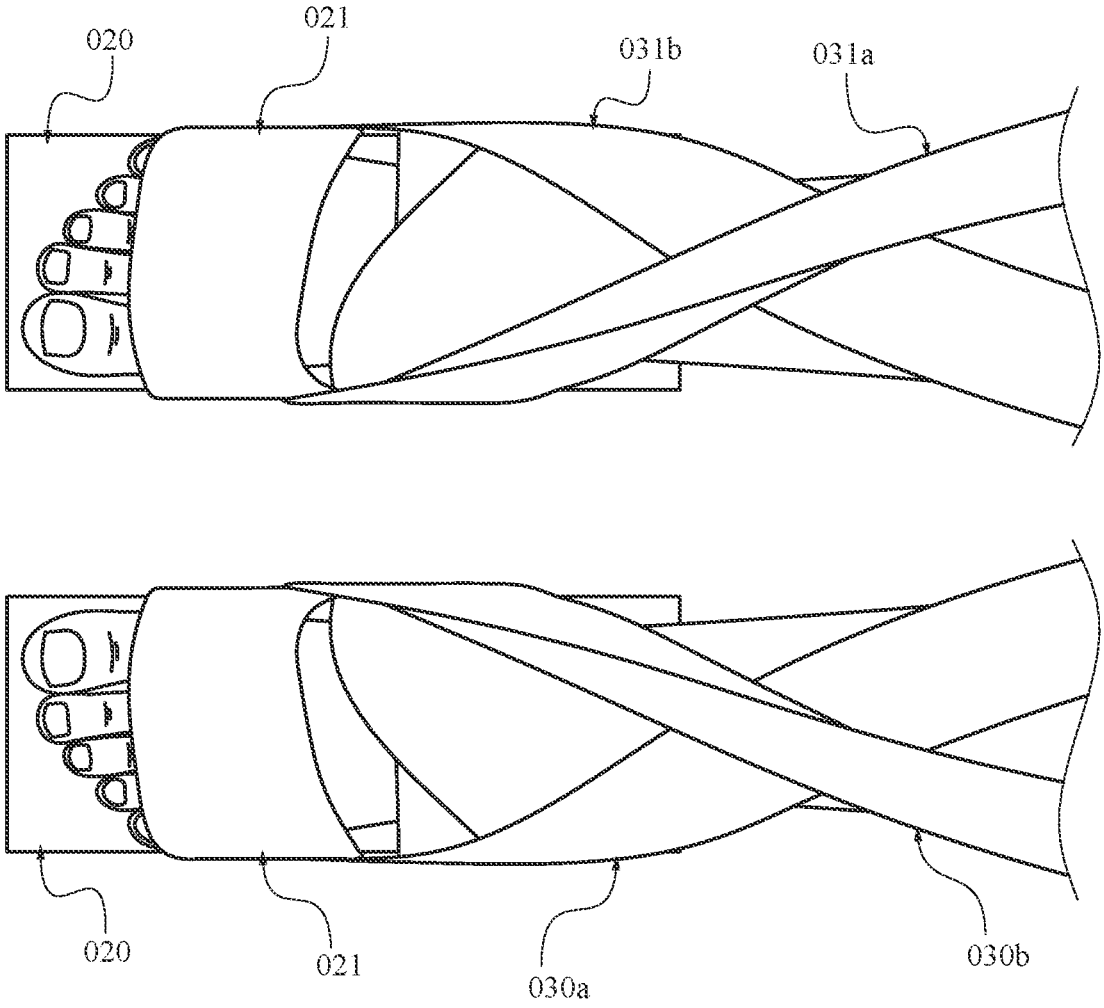
FIG. 4 is the partial top view of the Achilles tendon retro-stretch angle unit of the first embodiment of the present invention the operation state.

Referring to FIGS. 3*b* and 4, a sole fastening unit 021 is configured on one of the Achilles tendon retro-stretch angle units 020. In this embodiment, the sole fastening unit 021 is implemented with the elastic fabrics strap having VELCRO. The elastic fabrics strap repeatedly ties the Achilles tendon retro-stretch angle unit 020 and the foot of the user together, and therefore the tight contact between the Achilles tendon retro-stretch angle unit 020 and the foot of the user is made. However, the sole fastening unit 021 still can be implemented with other approaches, such as various buckles or the structure similar to a shoe, to establish the tight contact.

Figure 5:
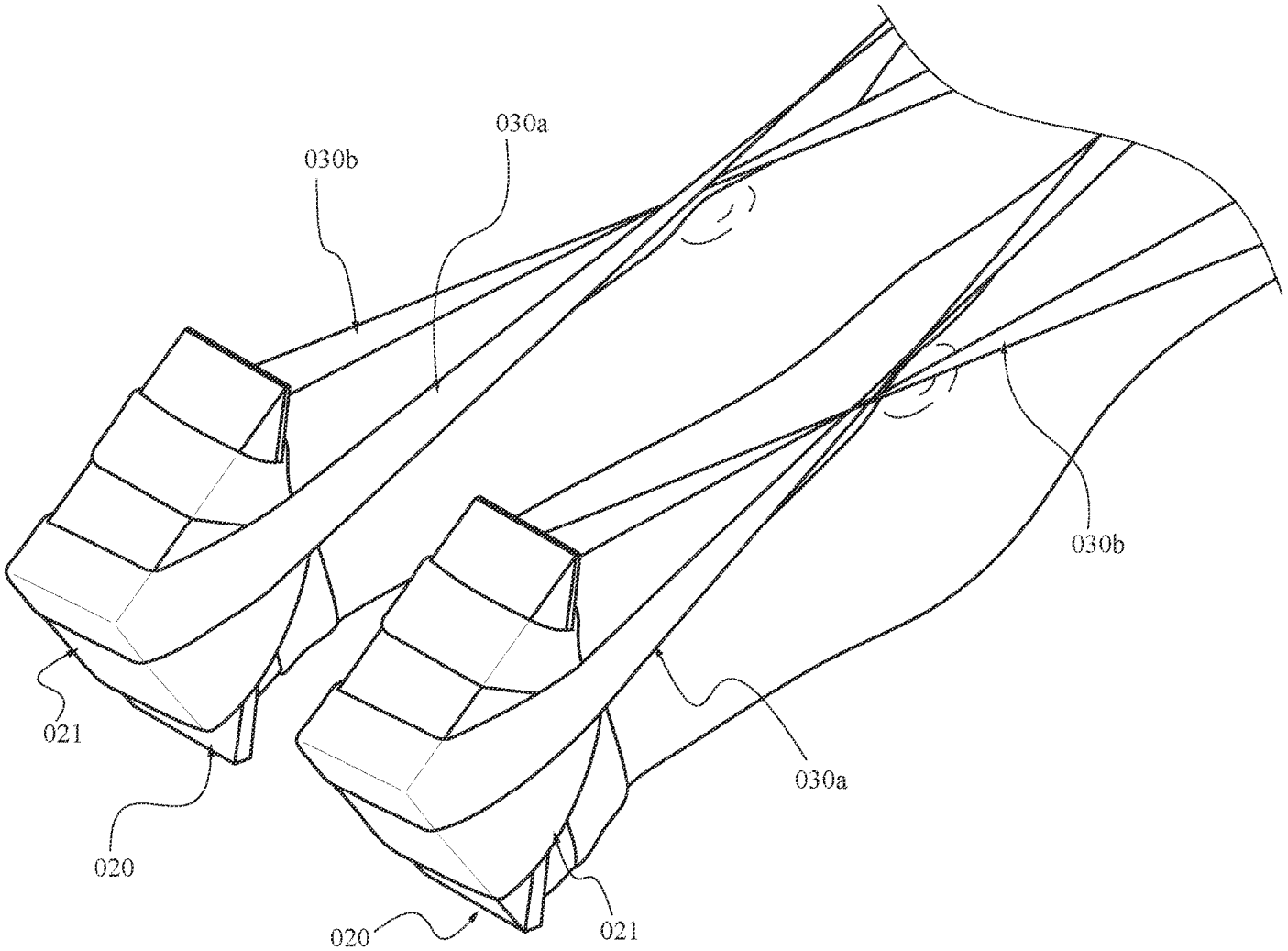
FIG. 5 is the partial perspective view of the Achilles tendon retro-stretch angle unit of the first embodiment of the present invention in the operation state.
Figure 6:
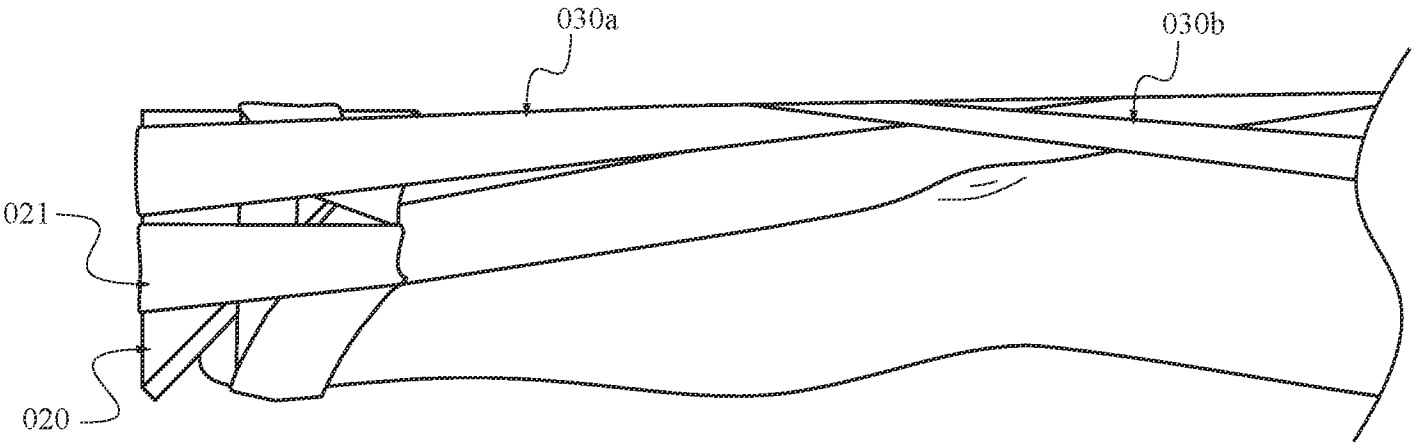
FIG. 6 is the partial side view of the Achilles tendon retro-stretch angle unit of the first embodiment of the present invention in the operation state.

Referring to FIG. 5, the user can gradually stretch both legs after the user wears the waist harness 010 and tightly fastens the Achilles tendon retro-stretch angle units 020 with the feet of the user. As FIG. 5, the angle between the crural and foot is around 90 degree when the stretch does not reach the end posture. As FIG. 6, when the end posture is reached, the collaboration of the first left extension unit 030*a* and the second left extension unit 030*b* applies upon the Achilles tendon retro-stretch angle unit 020 and the foot, and therefore the foot are bended and flexion toward the user's ventral side to achieve the effect of stretching the Achilles tendon and the muscles of the posterior thigh and calf By the same reason, the same effect also can be achieved with the first right extension unit 031*a* and the second right extension unit 031*b*.

Figure 7:
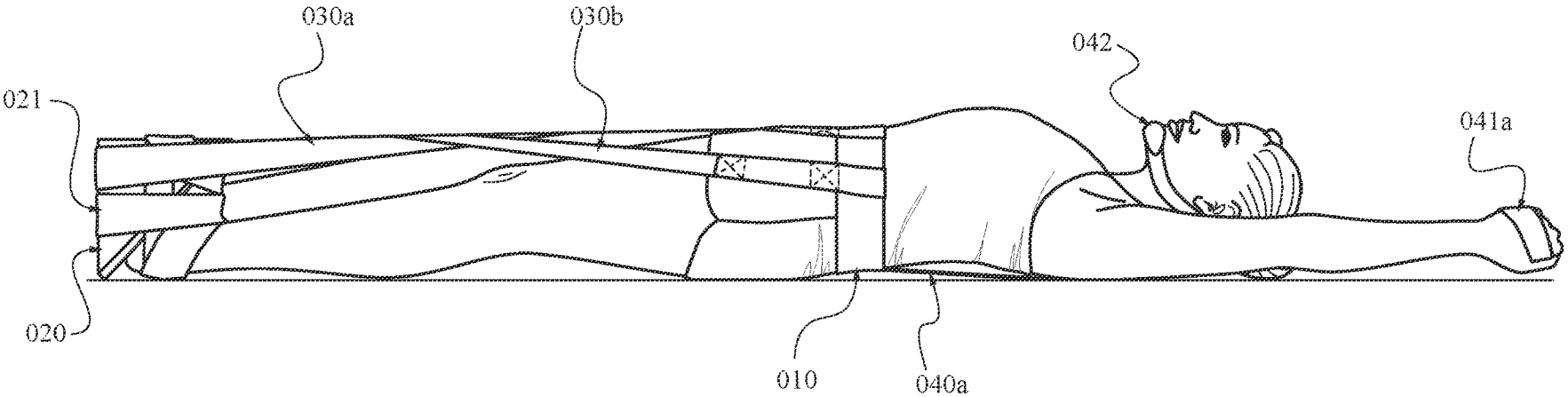
FIG. 7 is the side view of the first embodiment of the present invention in the operation state.

In summary, the integral approach to use the present invention is described as follows. The user wears the waist harness 010 on the waist, keeps the knees in the flexed position, and ties the Achilles tendon retro-stretch angle units 020 and the feet together with the sole fastening units 021. After that, the user lies down on a surface, and holds the two wrist loops 041*a* (and 041*b*) with both hands respectively, or hangs the two wrist loops 041*a* (and 041*b*) on both wrists respectively. Next, the user extends both legs and holds both hands over the user's head, and finally reaches the state as shown in FIG. 7. It is easy to observe if both hands reach the same position in the end when using the present invention, the present invention not only has the effect of stretching the muscles of lower limbs and tendons, but also has the remarkable effect of assisting in restoring spinal column and stretching upper limbs evenly.

There is no organs to generate pressure to facilitate the liquid flow within the lymphatic system and vein pipeline in human body. The present invention can help the user to fully stretch his/her limbs and make the lymphatic system and vein pipeline, which are frequently compressed, get diastolic to achieve the goal of promoting the circulation.

Further, the movable anchoring unit can functionally replace the exerting muscles to make the user extend his/her muscles comfortably. The upper body already fully extends in the end posture, and therefore the exerting muscles are allowed to be relaxed and spinal column and scapulas are not under pressure anymore. Accordingly, the present invention also can achieve the effect of cervical the spinal/lumber traction, and can improve the habits of poor posture and promote the reset about the spinal column. Accordingly, the present invention can stretch the muscles without actions of the antagonistic muscles thereof. The goal of pure stretch can be achieved. Either the office workers or the athletic, people use the muscles in the ventral side more often. However, keeping muscles in the high tension state is not conductive to sleep. The effect of pure stretch brought by the present invention can relieve tension and relax user's body, and therefore the sleeping quality will get better.

Figure 8A:
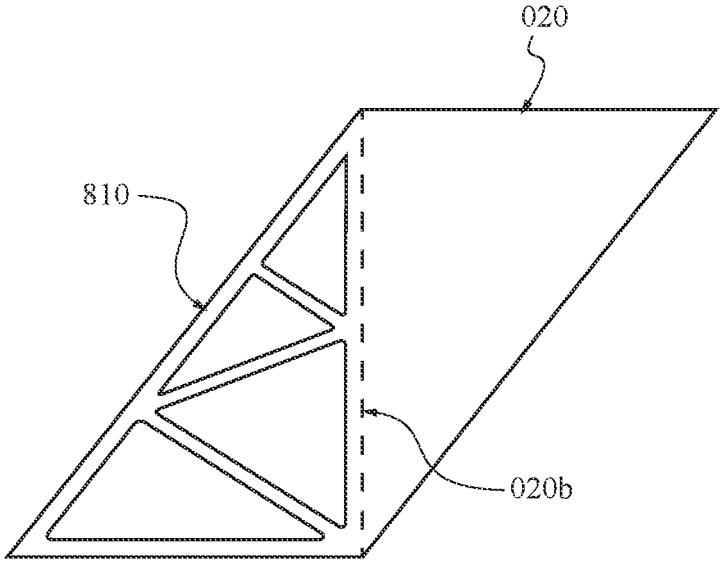
FIGS. 8*a*, 8*b*, 8*c* are the various implementations of the support unit of the present invention.

Referring to FIG. 8*a*, to overcome the defense mechanism of human instinct and the uncertainty about the extent of the foot forward flexing toward the ventral side, an additional support unit 810 is added to the present invention at the bottom surface 020*b* of the Achilles tendon retro-stretch angle unit 020. The support unit 810 has a fixed shape to keep the angle between the Achilles tendon retro-stretch angle unit 020 and the floor constant so that the user is aware that if the extent of muscle exertion is proper. Because people are used to contract the Achilles tendon, the lower limbs may not adapt to the abovementioned posture. That may cause the end posture to be insufficient or inaccurate when stretching. The support unit 810 facilitates the implementation of ideal stretching angle and prevents the loss of the effect of stretching when the tendon excessively resists the tension generated by the lower limb extension unit. To further prevent the resistance from the tendon, a counterweight block can be configured on the diverging end 020*d* to produce downward force against the resistance.

Figure 8B:
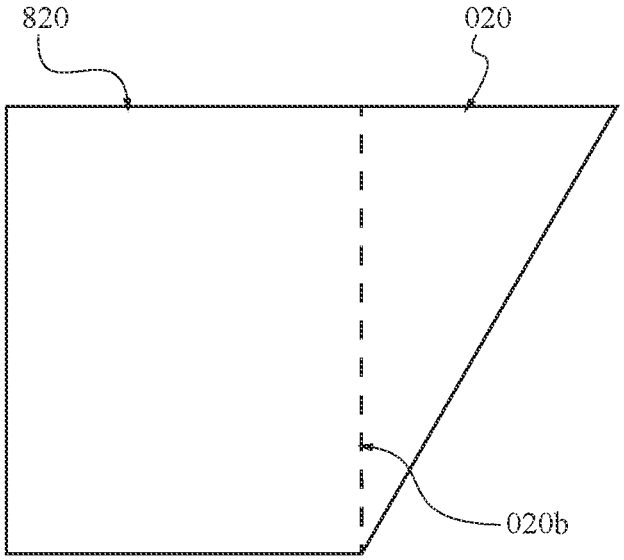

Referring to FIG. 8*b*, this is another embodiment of the support unit and the broken line in the figure stands for the virtualized bottom surface 020*b*, wherein the support unit 820 and the Achilles tendon retro-stretch angle unit 020 are made in one piece. In the support unit 820, the surface contacting the floor acts as a standard surface, so that the user is aware that if the extent of exerting is proper.

According to FIG. 8*a* and FIG. 8*b* the effect of resistance from the tendon can be overcome after applying the support unit and the counterweight block can provide additional assistance for the user to achieve the proper end posture. However, the lower limb extension unit 030*a* (or 030*b*, 031*a*, 031*b*) still has the chance to lead the foot twist to the right or the left. To prevent this possibility, an additional support can be configured at the converging end 020*c* of each Achilles tendon retro-stretch angle unit 020.

Figure 8C:
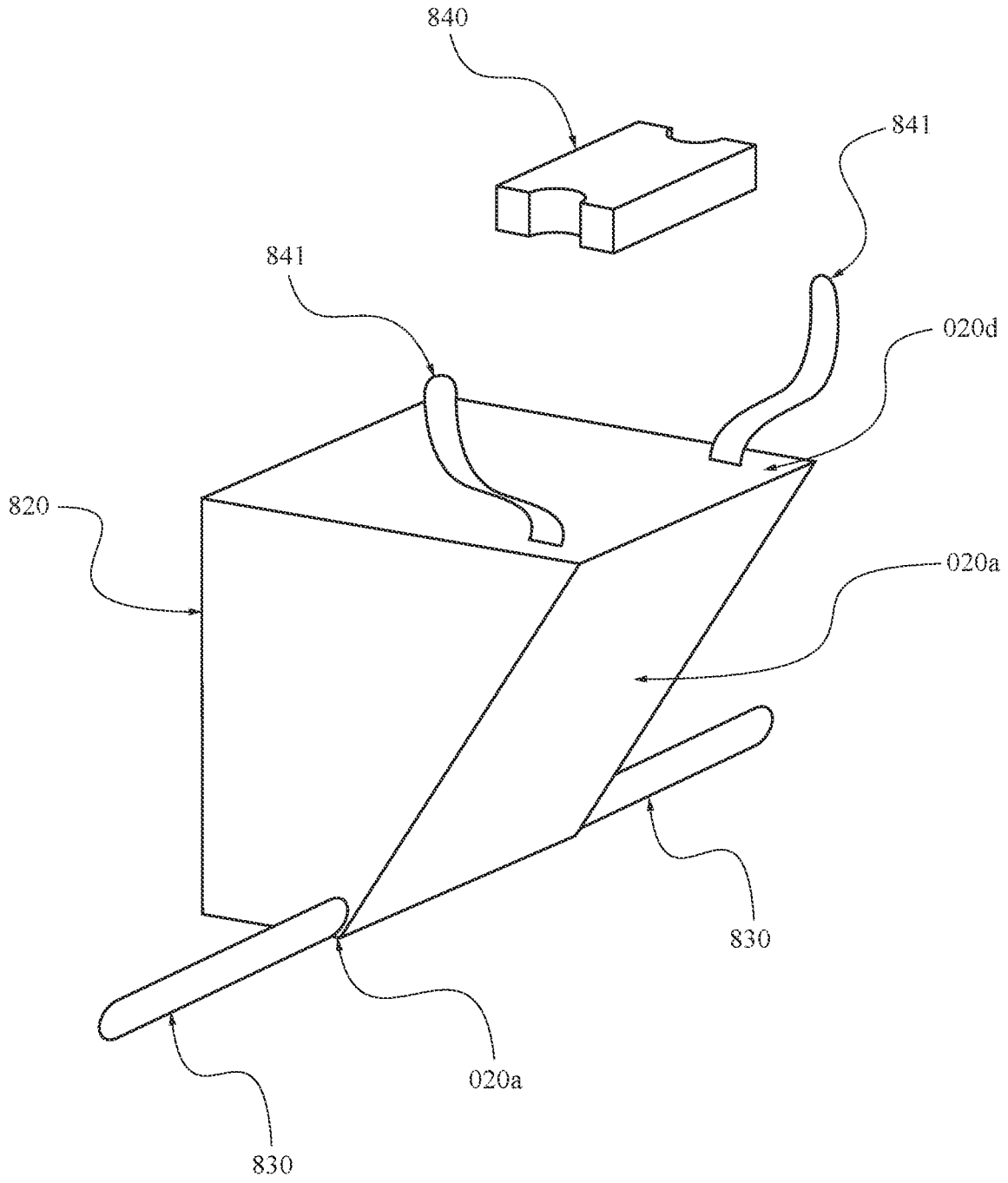

Referring to FIG. 8*c*, this is a perspective view of another embodiment. Based on the embodiment shown in FIG. 8*b*, one counterweight block 840 and two additional supports 830 are configured on single Achilles tendon retro-stretch angle unit 020. The counterweight block 840 is configured on the diverging end 020*d* to function as above mentioned. Two fasten strips 841 attached on the diverging end 020*d* are adopted to tie the counterweight block 840 in this embodiment. However, the means for fastening the counterweight block 840 are not limited to fasten strips. The tenon-mortise structure, coupling bolt structure or VELCRO structure are also usable to fasten the counterweight block 840. The additional supports 830 are configured at the converging end 020*c* to support the Achilles tendon retro-stretch angle unit from both right and left sides and to prevent the Achilles tendon retro-stretch angle unit from rollover toward the right or the left.

Figure 9A:
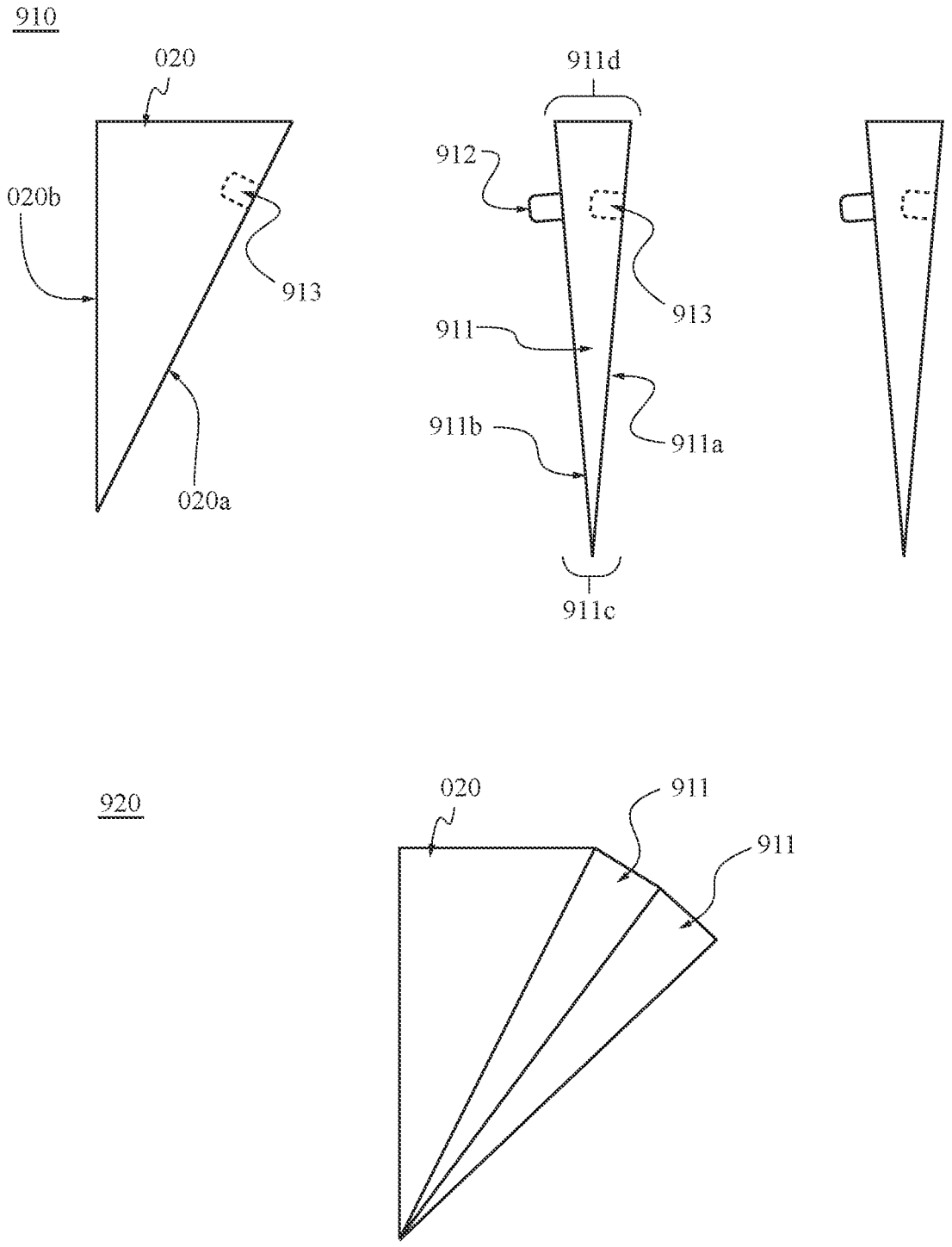
FIGS. 9*a*, 9*b* and 9*c* are the derived embodiments of the Achilles tendon retro-stretch angle unit of the present invention.

Compared with FIG. 9*a*, which is another embodiment of the Achilles tendon retro-stretch angle unit 020 based on the abovementioned embodiment. In the abovementioned Achilles tendon retro-stretch angle unit 020, if the angle between the bottom surface 020*b* and the sole contact surface 020*a* is too large, the angle that the foot forward flaxes toward ventral will be too large accordingly. This condition may result in the psychological resistance to the present invention for the beginner. Therefore, the angle between the bottom surface 020*b* and the sole contact surface 020*a* should be smaller. However, for those who are experienced at stretching, the wedge part provided by the present invention can be used for increasing the angle between the bottom surface 020*b* and the sole contact surface 020*a*.

Referring to the disassembling Achilles tendon retro-stretch angle unit 910, the wedge part 911 essentially includes a contact surface 911*b* and a non-contact surface 911*a*, which are not parallel to each other, so that the wedge part 911 forms a wedge converging end 911*c* and a wedge diverging end 911*d*. The wedge part 911 and the Achilles tendon retro-stretch angle unit 910 can connect with each other by the connection between the contact surface 911*b* and the sole contact surface 020*a*, wherein the wedge diverging end 911*d* corresponds to the diverging end 020*d*, and the wedge converging end 911*c* corresponds to the converging end 020*c*. Therefore, the user can optionally increase the number of the wedge part 911 to increase the angle that the foot forward flexes toward the ventral side.

In the abovementioned embodiment, the connection between the contact surface 911*b* and the sole contact surface 020*a* can be implemented with a tenon 912 and a mortise 913, so that the wedge part 911 and the Achilles tendon retro-stretch angle unit 020 compose the assembling Achilles tendon retro-stretch angle unit 920. However, the means to attach the wedge part 911 and the Achilles tendon retro-stretch angle unit 020 are not limited to the tenon and the mortise. Any means for assembling can be applied to this condition.

Figure 9B:
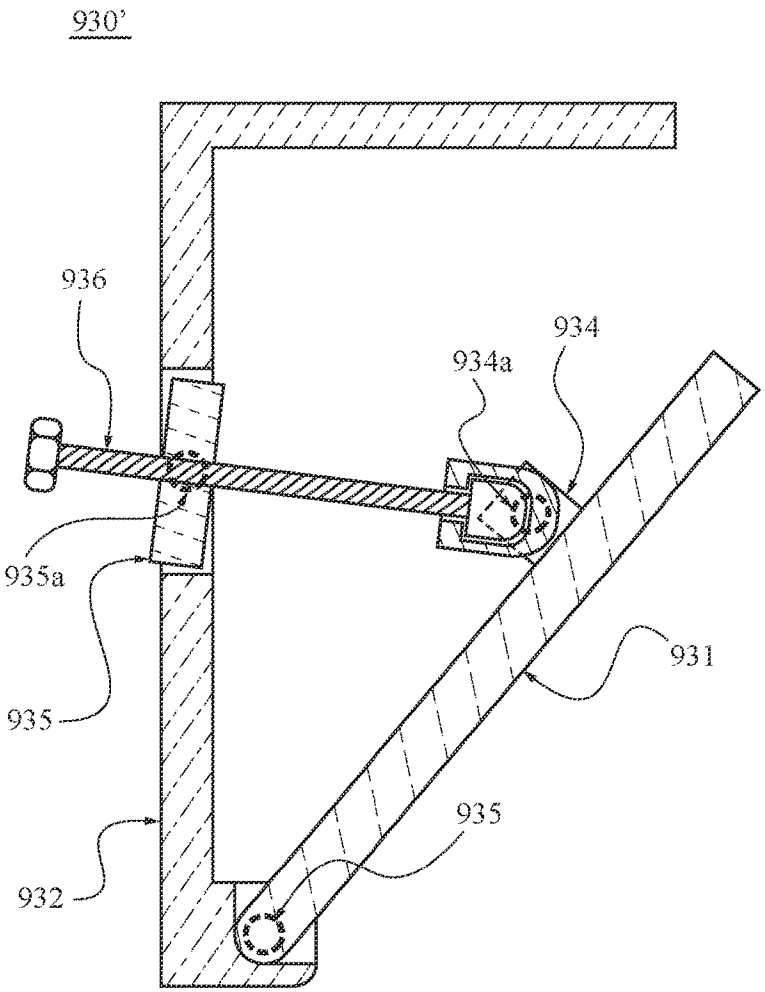
Figure 9B:
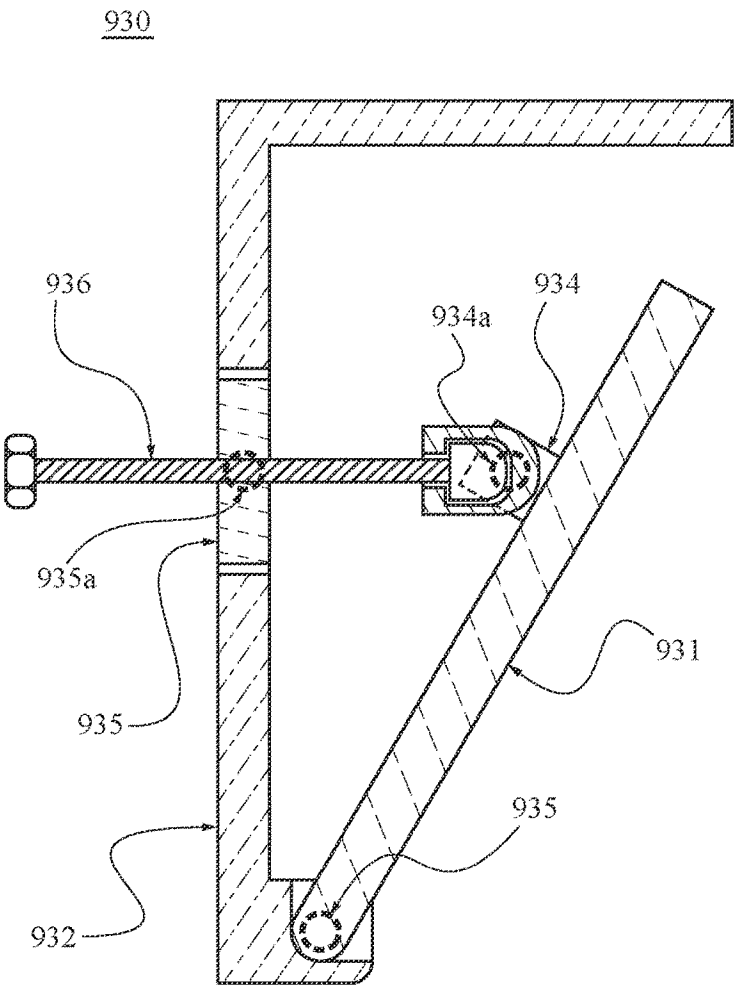

Referring to FIG. 9*b*, the present invention also provides another Achilles tendon retro-stretch angle unit 930. The sole contact surface 931 and the bottom surface 932 of the Achilles tendon retro-stretch angle unit 930 are connected with the first pivot 933 to replace the original converging end 020*c*, wherein the angle between the sole contact surface 931 and the bottom surface 932 can be adjusted through a threaded rod structure. The threaded rod structure includes a base 934, a base pivot 934*a*, a threaded rod 936, an acorn nut 936*a*, and a rotatable nut plate 935, wherein the base 934 is configured in the Achilles tendon retro-stretch angle unit 930 and fixed on the inside of the sole contact surface 931. The rotatable nut plate 935 is configured at the bottom surface 932 with a second pivot 935*a*. As the threaded rod 936 being screwed inward, the acorn nut 936*a* is driven forward to push the sole contact surface 931 through the base pivot 934*a*. Therefore, the sole contact surface 931 is moved outward and the angle between the sole contact surface 931 and the bottom surface 932 is enlarged. In the other hand, if the threaded rod 936 is screwed reversely, the angle between the sole contact surface 931 and the bottom surface 932 is reduced. The Achilles tendon retro-stretch angle unit 930' is the state of Achilles tendon retro-stretch angle unit 930 after the threaded rod structure is carried inward, and the action for changing the angle of the sole contact surface 931 in the embodiment can be understood clearly through this demonstration.

Figure 9C:
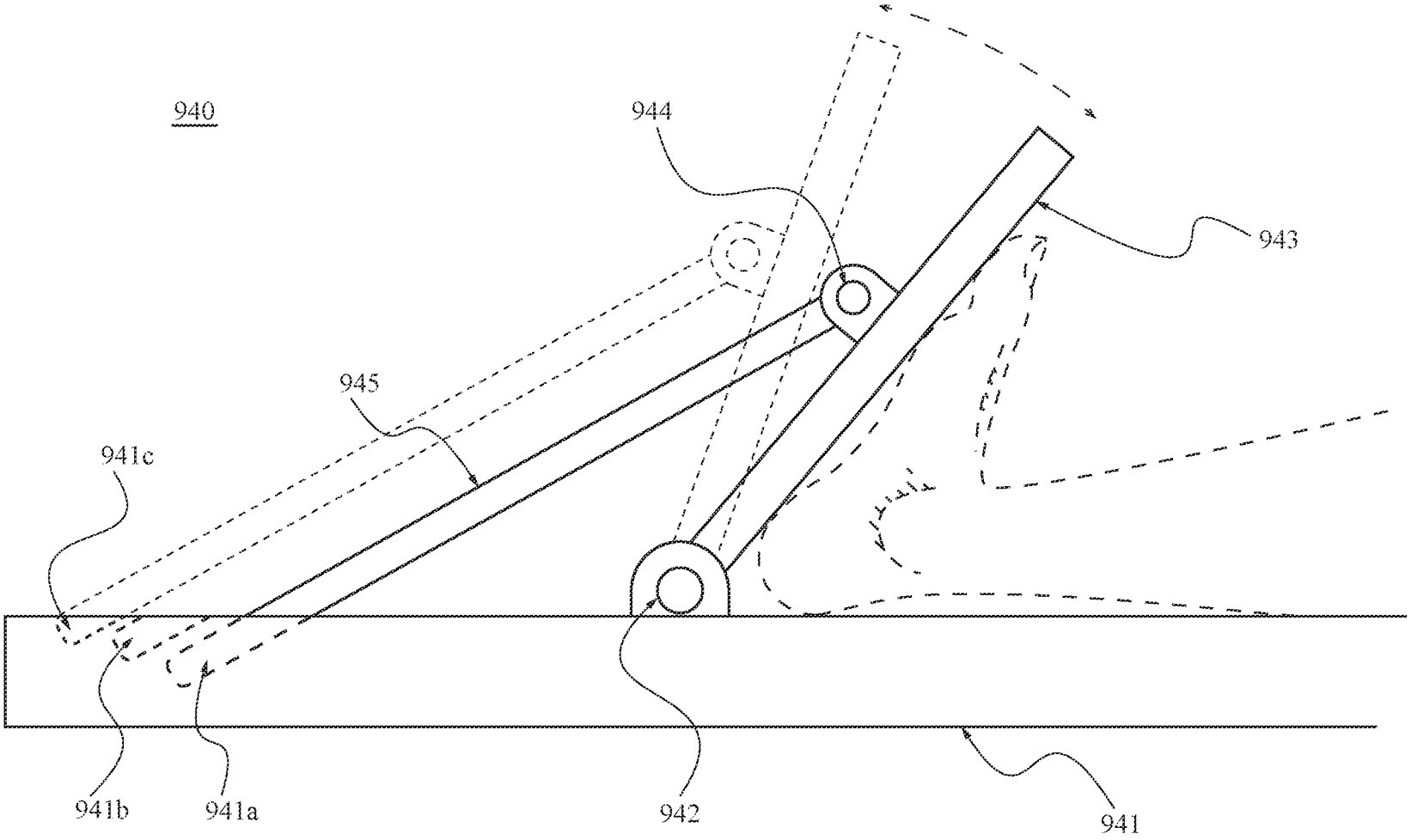

Referring to FIG. 9*c*, the present invention further provides another Achilles tendon retro-stretch angle unit 940, which includes a base plate 941, a sole contact plate 943 and a support pole 945, wherein the sole contact plate 943 connects with the base plate 941 through a base plate hinge 942, the support pole 945 connects with the sole contact plate 943 through a pivot of the support pole 944, and the base plate 941 has several accommodating holes 941*a*-941*c*, which are configured on the surface facing the support pole 944. The distances between the base plate hinge 942 and the accommodating holes 941*a*-941*c* respectively are different and from small to large. These accommodating holes can hole the end of the support pole 945, wherein the end is not attached to the pivot of the support pole 944. Therefore, the sole contact plate 943 can be erected in different angles.

In this embodiment, the lower limb extension unit is allowed to connect with the base plate 941 or the sole contact plate 943, and the sole fastening unit 021 can be configured on the sole contact plate 943. During the operation, the base plate 941 is placed on the floor stably, the foot of the user steps on the surface of the sole contact plate 943 without the support pole 944, and the user exerts his/her muscles as the abovementioned approach to operate. The difference from the abovementioned embodiments is that the Achilles tendon retro-stretch angle unit 940 can be set separately for the right and left feet, or alternatively it can be made in a wider shape for both feet to step on at the same time.

No matter what kind of implementations for the Achilles tendon retro-stretch angle unit is, to prevent the feet of the user from slipping out of the sole contact surface of the Achilles tendon retro-stretch angle unit due to further exertion, an ankle fastening unit is configured on each of the Achilles tendon retro-stretch angle units in the present invention. The ankle fastening unit is set at converging end of the Achilles tendon retro-stretch angle unit or at the position on the sole contact plate 943 near the base plate hinge 942, where is close to the ankle of the user, and therefore the Achilles tendon retro-stretch angle unit and the foot of the user are engaged more firmly when the ankle fastening unit and sole fastening unit collaborate together.

The ankle fastening unit is implemented with the elastic fabrics strap with VELCRO. The elastic fabrics strap repeatedly ties the Achilles tendon retro-stretch angle unit and the ankle of the user together, and therefore the tight contact between the Achilles tendon retro-stretch angle unit and the ankle of the user is made. However, the ankle fastening unit still can be implemented with other approaches, such as buckle or clasp.

Furthermore, to collaborate with different Achilles tendon retro-stretch angle units, the abovementioned movable anchoring unit can be implemented in another approach. In this approach, the movable anchoring unit includes a long strap wherein a fastening structure, such as a hook or a loop unit, is configured at one end of the long strap and a connector is configured at the other end of the long strap. When operating under this approach, user has to use the present invention with the collaboration of one bed or other platform structure that allows the user to lie down on it. The connector connects the Achilles tendon retro-stretch angle unit, the long strap spans over the bottom side of the bed, and the fastening structure is placed at the position that the wrist loop locates when the end posture is reached. Alternatively, user can stretch to the end posture, and then hangs the wrist loop 041*a* (or the wrist loop 041*b*) on the hook or puts the wrist of the user into the loop unit (or holds the loop unit) to keep the end posture of the stretch. In conclusion, the purpose of the movable anchoring unit is for the user to lay his wrists upon it, so as to counter balance, or cancel, all the force that the user has to exert for pulling up the upper limb extension unit. It can be regarded as the movable anchoring unit is fixed or spans around a fixture to counter, or balance, the force created by the upper limb extension unit, and the lower limb extension unit. Under this condition, the user may just lay in this position, and does not have to exert any force while enjoying the benefit of whole body relaxation.

To provide further protection, different cushions can be adopted to prevent the user from sports injuries. Referring to FIG. 2, a waist cushion can be placed under the waist of the user to provide additional support and keep the waist in a good posture. Based on the same reason, a neck cushion can be applied under the neck of the user. In terms of appearance, the cushion should at least have a flat surface to contact the floor and an arc surface to contact the body of the user to support and keep skeleton in the right position and orientation. The abovementioned principle applies to both of the cushions.

Overall, there are 31 pairs of nerves distributing along vertebrae and extending out from intervertebral foramina. They control the muscles and organs within human body and directly affect the actions of limbs and the operations of organs. If these nerves are compressed, in the mild condition, individual will feel the pain, but in the severe condition, individual will loss the control and awareness to limbs. Even in the vertebral subluxation condition without abovementioned syndromes, due to the displacement of the most important framework to human body, individual will slightly change the way of working to the other limbs and joints unconsciously in response to the displacement. The change in response to the displacement will easily cause the joint to be abraded abnormally. The present invention stretch the Achilles tendon, shoulder, and spinal column of the user in the way reverse to habitual postures by the force from the user self to reach the effect to relax overall muscles. Furthermore, the present invention promotes the restoration of spinal column. The user may stretch a wide range of his body while using this present invention, and he may realize the effectiveness within a very short time. The effect of full relaxation could be promptly achieved while operating this invention for quite a short time, such as half an hour.

The invention need not be limited to the disclosed embodiments and the wording/terms, and it is intended to cover various modifications and similar arrangements included within the spirit of the present invention and the scope of the appended claims.

What is claimed is:

1. A stretch exercise system, comprising:

a waist harness having a ventral portion and a dorsal portion;

an upper limb extension unit having a right upper limb elastic strap and a left upper limb elastic strap symmetrically configured at the dorsal portion, wherein each of the upper limb elastic straps has a wrist loop;

a lower limb extension unit having a right lower limb elastic strap unit configured at the ventral portion, and having a left lower limb elastic strap unit configured at the ventral portion;

two Achilles tendon retro-stretch angle units each having at least a bottom surface and a sole contact surface, wherein the bottom surface and the sole contact surface are not parallel to each other to form a diverging end and a converging end respectively, the right lower limb elastic strap unit connects with the diverging end of one of the two Achilles tendon retro-stretch angle units, and the left lower limb elastic strap unit connects with the diverging end of the other of the two Achilles tendon retro-stretch angle units; and two sole fastening units respectively configured on the Achilles tendon retro-stretch angle units to hold feet of a user on the sole contact surfaces and align toes of the feet of the user with the diverging ends respectively, whereby a static balance is reached by the user with an upper push force applied on the upper limb extension unit and a lower push force applied on the Achilles tendon retro-stretch angle units.

2. The stretch exercise system as claimed in claim 1, further comprising an ankle fastening unit configured for securing one of the feet of the user on one of the sole contact surfaces and aligning a tip of a toe of one of the feet of the user with one of the diverging ends.

3. The stretch exercise system as claimed in claim 1, further comprising a connect unit for connecting the wrist loops.

4. The stretch exercise system as claimed in claim 1, further comprising a mandible harness unit configured for pulling a head of the user and aligning a neck and a spine of the user, wherein the mandible harness unit connects the right upper limb elastic strap and the left upper limb elastic strap.

5. The stretch exercise system as claimed in claim 1, further comprising a support unit configured on each Achilles tendon retro-stretch angle unit for upholding the respective bottom surface to maintain a constant angle relative to a floor.

6. The stretch exercise system as claimed in claim 1, further comprising an additional support configured on the converging end wherein the additional support is parallel to a floor to prevent the respective Achilles tendon retro-stretch angle unit from rollover.

7. The stretch exercise system as claimed in claim 1, further comprising a counterweight block configured on the diverging end to provide a downward force.

8. The stretch exercise system as claimed in claim 1, further comprising a wedge part having at least a contact surface and a non-contact surface, wherein the contact surface and the non-contact surface are not parallel to each other to form a wedge diverging end and a wedge converging end, and the wedge part is capable of being attached to the sole contact surface with the contact surface in a direction such that the wedge diverging end is aligned with the diverging end and the wedge converging end is aligned with the converging end.

9. The stretch exercise system as claimed in claim 1, further comprising a threaded rod engaging through the bottom surface and supported by the sole contact surface, whereby an angle between the bottom surface and the sole contact surface is capable of being adjusted by screwing the threaded rod in and out of the bottom surface.

10. The stretch exercise system as claimed in claim 1, further comprising a movable anchoring unit configured for holding a wrist of the user, whereby the movable anchoring unit is capable of being tied with a fixture configured to counter a contraction resulting from the upper limb extension unit.

11. The stretch exercise system as claimed in claim 1, further comprising a movable anchoring unit configured for holding a wrist of user and connecting the respective Achilles tendon retro-stretch angle unit, whereby the movable anchoring unit spans around a fixture and is configured to counter contractions resulting from the upper limb extension unit, the lower limb extension unit and the movable anchoring unit.

12. The stretch exercise system as claimed in claim 1, wherein the right lower limb elastic strap unit at least includes a first right extension unit connecting with the diverging end and a second right extension unit connecting with the respective Achilles tendon retro-stretch angle unit, whereby a pushing force is capable of being absorbed by the first right extension unit and the second right extension unit to prevent the respective Achilles tendon retro-stretch angle unit from flipping.

13. A stretch exercise system, comprising:

a waist harness having a ventral portion and a dorsal portion;

an upper limb extension unit having at least one upper limb elastic strap connecting a wrist loop and the dorsal portion;

a lower limb extension unit having at least one lower limb elastic strap unit configured at the ventral portion and corresponding to the at least one upper limb elastic strap;

an Achilles tendon retro-stretch angle unit having at least a bottom surface and a sole contact surface, wherein the bottom surface and the sole contact surface are not parallel to each other to form a diverging end and a converging end, and the at least one lower limb elastic strap unit at least connects the diverging end; and a sole fastening unit configured on the Achilles tendon retro-stretch angle unit for holding one foot of a user.

* * * * *